United States Patent [19]

Ayata et al.

[11] Patent Number: 4,637,453

[45] **Date of Patent: * Jan. 20, 1987**

[54] METHOD FOR THE CONTINUOUS PRODUCTION OF CAST STEEL STRANDS

[75] Inventors: Kenzo Ayata; Kiichi Narita, both of Kobe; Takasuke Mori, Ashiya; Takahiko Fujimoto, Kobe, all of Japan

[73] Assignee: Kabushiki Kaisha Kobe Seiko Sho, Kobe, Japan

[ * ] Notice: The portion of the term of this patent subsequent to May 7, 2002 has been disclaimed.

[21] Appl. No.: 642,659

[22] Filed: Aug. 21, 1984

Related U.S. Application Data

[63] Continuation-in-part of Ser. No. 561,149, Dec. 14, 1983, Pat. No. 4,515,203, which is a continuation of Ser. No. 250,041, Apr. 1, 1981, abandoned.

[30] Foreign Application Priority Data

| | | | |
|---|---|---|---|
| Apr. 2, 1980 | [JP] | Japan | 55-43339 |
| Apr. 2, 1980 | [JP] | Japan | 55-43341 |
| Apr. 20, 1980 | [JP] | Japan | 55-43340 |

[51] Int. Cl.[4] ..... B22D 27/02; B22D 11/16

[52] U.S. Cl. ..... 164/468; 164/504; 164/472

[58] Field of Search ..... 164/468, 504, 472

[56] References Cited

U.S. PATENT DOCUMENTS

| | | | |
|---|---|---|---|
| 3,656,537 | 4/1972 | Von Starck | 164/468 |
| 4,515,203 | 5/1985 | Narita et al. | 164/468 |

*Primary Examiner*—Nicholas P. Godici
*Assistant Examiner*—Samuel M. Heinrich
*Attorney, Agent, or Firm*—Oblon, Fisher, Spivak, McClelland, & Maier

[57] ABSTRACT

A method for the continuous production of cast steel strands which are 200 mm×200 mm or less in cross-section by a continuous casting process in which molten steel containing 0.20% or less of carbon is fed into a casting mold with a lubricant through a submerged nozzle or in an open stream and continuously drawn out downwardly of the casting mold. The method includes the steps of (a) electromagnetically stirring the molten steel at a position within said casting mold by the application of a magnetic field induced by introducing into an electromagnetic coil an alternating current of a frequency (f) in the range of 1.5 to 15 hertz and maintaining the magnetic flux density (Gaub) in the range of $602e^{-0.10f}$ to $2441e^{-0.11f}$ at the center of the electromagnetic coil, and (b) electromagnetically stirring the molten steel at a position in the final solidifying zone, of said continuously cast strand, in which the shorter diameter of the molten steel pool is smaller than ½ the length of the shorter side of the cast strand, by the application of a magnetic field induced by introducing an alternating current into an electromagnetic coil and maintaining the magnetic flux density (Gaub) in the range of $0.2 \cdot D^2+280$ to $0.343 \cdot D^2+451$ at the center of the electromagnetic coil, wherein D is the solidified shell thickness in millimeters of said continuously cast strand, the value of D ranging from 20 to 90. The method thereby permits the production of low carbon killed steel billets which are improved as to negative segregations, center cavities, inclusions, surface quality, cold forgeability, and machinability, by a continuous casting process at low cost.

12 Claims, 14 Drawing Figures

NO STIRRING

M STIRRING

M + S STIRRING

M + F STIRRING

M+S+F STIRRING

METHOD FOR THE CONTINUOUS PRODUCTION OF CAST STEEL STRANDS

BACKGROUND OF THE INVENTION

This is a continuation-in-part application of our copending application Ser. No. 561,149 filed on Dec. 14, 1983, now U.S. Pat. No. 4,515,203, which is a continuation of application Ser. No. 250,041 filed on Apr. 1, 1981, now abandoned.

This invention relates to a method for producing low carbon killed steels, especially billets having a small size in cross-section, by a continuous casting process using an electromagnetic stirring technique.

In a continuous steel casting, there arise problems of defects as detected by an ultrasonic test, e.g., inclusions occurring in a sub-surface or internal portion of a continuously cast strand (hereinafter referred to as "the c.c. strand" for brevity) in its solidifying stage and shrinkage cavities are produced in axial center portions of the c.c. strand. In addition, strong segregations occur in the c.c. strands at a high temperature in continuous casting operations.

Various attempts have thus far been made to eliminate the internal defects of the c.c. strands, including center segregations and shrinkage cavities, through a single electromagnetic stirring either within a mold or in a secondary cooling zone, and severing tip ends of growing crystals with fluidic movements of molten steel to produce a large quantity of equiaxed crystal nuclei, thereby expanding the equiaxed crystal zone in the center portion of the c.c. strands. However, none of the attempts have succeeded in sufficiently reducing the ratio of center segregations and irregularities of center segregations in the axial direction of the c.c. strands, failing to produce steel castings of satisfactory quality.

On the other hand, the nozzle diameter (about 12–15 mm) of a continuous type billet-casting machine is inherently smaller than that of a continuous type bloom-casting machine due to its structural features, so that when molten steel containing Al in a high concentration is treated by a billet-casting machine, $Al_2O_3$-inclusions are attached to the nozzle resulting in a nozzle blockage which makes the billet casting difficult. For this reason, Si-killed steels deoxidized with Si are generally applied to such a billet-casting machine, but a number of blow holes exist on the resulting billet due to insufficient deoxidization therein, thereby causing scars and/or cracks on the surface of the product obtained from the billet by rolling and/or forging work.

Moreover, where a billet-casting machine is used, the molten steel flows at a high speed within a narrow space in the mold thereby drawing inclusions into the lower region of the molten steel so that the inclusions cannot be eliminated from the molten steel, resulting in a large amount of inclusions in the billet, producing a product which is inferior in quality when compared with blooms having a large size in cross-section.

In the production of low carbon killed steels by a billet-casting machine, center cavities are formed as a peculiarity of the steels. When the resulting c.c. strand was subjected to a succeeding heat treatment, scales occur not only on the surface of the c.c. strand, but also within the cavities open to the outside, and the scales within the cavities remain as inclusions in rolling work and/or cause cracks in cold forging work.

In order to obtain quality low carbon killed steel billets, therefore, blooms having a large size in cross-section have been produced by a continuous type bloom-casting machine, first, and then subjected to a rolling process. This process requires additional heating and rolling processes, causing an increase in the production cost.

SUMMARY OF THE INVENTION

The primary object of the present invention is to provide a method which overcomes the above-discussed drawbacks and which is capable of continuously producing quality cast steel strands (billets having an area of 200 mm×200 mm or less in cross-section) of low carbon killed steels by a continuous casting process.

It is another object of the present invention to provide a method which overcomes the abovediscussed drawbacks and which is capable of continuously producing, low carbon killed steels with less center cavities by a continuous steel casting process.

It is another object of the present invention to provide a method for the continuous production of quality billets at low cost by a continuous casting process.

In order to attain these objects, the method of the present invention is a method for the continuous production of cast steel strands which are 200 mm×200 mm or less in cross-section by a continuous casting process in which molten steel containing 0.20% or less of carbon is fed into a casting mold with a lubricant through a submerged nozzle or in an open stream and continuously drawn out downwardly of the casting mold, said method comprising the steps of:

(a) electromagnetically stirring the molten steel at a position within said casting mold by the application of a magnetic field induced by introducing into an electromagnetic coil an alternating current of a frequency (f) in the range of 1.5 to 15 hertz and maintaining the magnetic flux density (GauB) in the range of $602e^{-0.10f}$ to $2441e^{-0.11f}$ at the center of the electromagnetic coil, and (b) electromagnetically stirring the molten steel at a position in a final solidifying zone of said continuously cast strand, in which the shorter diameter of the molten steel pool is smaller than ½ the length of the shorter side of the cast strand, by the application of a magnetic field induced by introducing an alternating current into an electromagnetic coil and maintaining the magnetic flux density (GauB) in the range of $0.2 \cdot D^2+280$ to $0.343 \cdot D^2+451$ at the center of the electromagnetic coil, wherein D is the solidified shell thickness in millimeters of said continuously cast strand, the value of said D ranging from 20 to 90.

The method of the present invention further comprises the step of electromagnetically stirring the molten steel at a position in an intermediate solidifying zone of said continuously cast strand by the application of a magnetic field induced by introducing an alternating current into an electromagnetic coil and maintaining the magnetic flux density (GauB) in the range of $750000/(D-110)^2$ to $750000/(D-81)^2$ at the center of the electromagnetic coil, wherein D is the solidified shell thickness in millimeters of said continuously cast strand, a value of said D ranging from 10 to 50, and said intermediate solidifying zone being the zone between said casting mold and said final solidifying zone.

The lubricant is oil or powder. Where the lubricant is powder, the magnetic flux density at the center of the electromagnetic coil in said casting mold is in the range of $602e^{-0.10f}$ to $1339e^{-0.12f}$ gauss.

BRIEF DESCRIPTION OF THE DRAWINGS

This invention may be better understood and its numerous objects and advantages will become apparent to those skilled in the art by reference to the accompanying drawings as follows:

FIG. 9(*b*) is an illustration of an electromagnetic stirring device in each of the three steps according to this invention.

DESCRIPTION OF PREFERRED EMBODIMENTS

Figure 1:
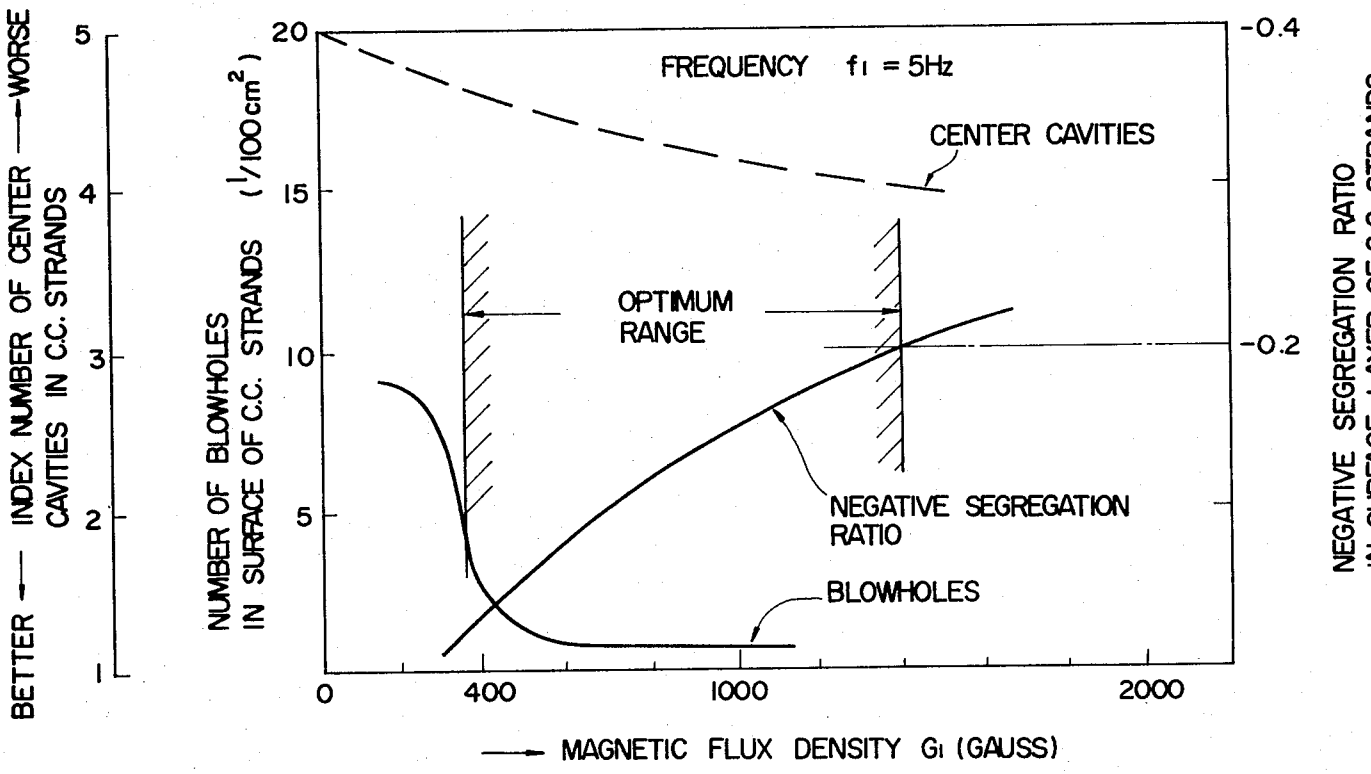
FIG. 1 is a diagram showing the relationship among the magnetic flux density $G_1$, the number of blowholes in the surface of c.c. strands, the index number of center cavities and the negative segregation ratio of carbon in the surface layer of the c.c. strand in the mold.

The electromagnetic stirring which provokes motivating forces in molten steel in a continuous steel casting process, if too weak, fails to reduce in a sufficient degree, the afore-mentioned inclusions, i.e. the cavities and center segregations. Excessively intense stirring will, on the other hand, act to drastically increase the amount of inclusions and the negative segregations in the c.c. strands. Therefore, in consideration of the inclusion levels as well as the ratios of negative and center segregations, the inventors have carried out extensive experiments and studies of various factors in electromagnetic stirring for producing steel materials of satisfactory quality by the continuous casting process, thus attaining the present invention.

The method of the present invention is now illustrated by way of an example which applies to a low carbon killed steel.

Cast iron was melted by an electric furnace to obtain molten steel, the temperature of which was adjusted by a ladle furnace and which was fed into the mold of a continuous type billet-casting machine (which is capable of producing a billet having 125 mm×125 mm in cross-section) wherein the drawing rate was 2.6 m/min. The molten steel in the mold was electromagnetically stirred by a rotating magnetic field type-electromagnetic stirring means which is disposed at a position within the casting mold, a position in an intermediate solidifying zone (e.g. a position at a 3.8 m distance downwardly from the meniscus portion of the mold) and a position in the final solidifying zone, respectively. The molten steel had a chemical composition of C=0.11% by weight, Si=0.21% by weight, Mn=0.59% by weight, P=0.016% by weight, S=0.010% by weight, Al=0.003% by weight, Cu=0.16% by weight, Ni=0.07% by weight, Cr=0.14% by weight, Mo=0.02% by weight, Sn=0.016% by weight, O=86 ppm and N=133 ppm.

(I) Optimum conditions for stirring within the casting mold:

(I-1) Combination of a submerged nozzle or an open stream with oil casting:

The molten steel of the above-mentioned chemical composition was fed into a casting mold with a lubricant type oil (e.g., rapeseed oil) through a submerged nozzle or in an open stream.

As seen from FIG. 1, the number of blow holes on the surface of the c.c. strand drastically decreases with an increase in an alternating current flowing into the first electromagnetic coil, which is disposed in the casting mold, so as to increase the magnetic flux density $G_1$ at the center of the electromagnetic coil thereby increasing the intensity of the stirring within the casting mold. When the frequency $f_1$ of the alternating current is 5 Hz and the magnetic flux density $G_1$ becomes 350 or more, the number of blow holes became 5 or less per 100 $cm^2$. This can be explained from the fact that excess oxygen from the insufficiently deoxidized molten steel may be prevented from being trapped in a solidified shell, due to the fluidic movement of the molten steel by the intensive stirring.

Concentrated molten steel within the massy zone flows, due to fluidic movements thereof, thereby producing negative segregations in the solidified shell. Thus, as seen from FIG. 1, the negative segregation ratio increases with an increase in the intensity of the stirring. The negative segregation ratio is represented by $(C_{WB}\text{-Co})/\text{Co}$, wherein $C_o$ is a carbon concentration in the molten steel, and $C_{WB}$ is the lowest carbon concentration in the negative segregation zone resulted from the stirring.

On the other hand, the electromagnetic stirring in the mold has the effect of severing the columnar crystals which grow in the center portion of the c.c. strands, increasing the amount of equiaxed crystals. Thus, the center segregation ratio (C/Co) of carbon is linearly decreased.

Figure 2:
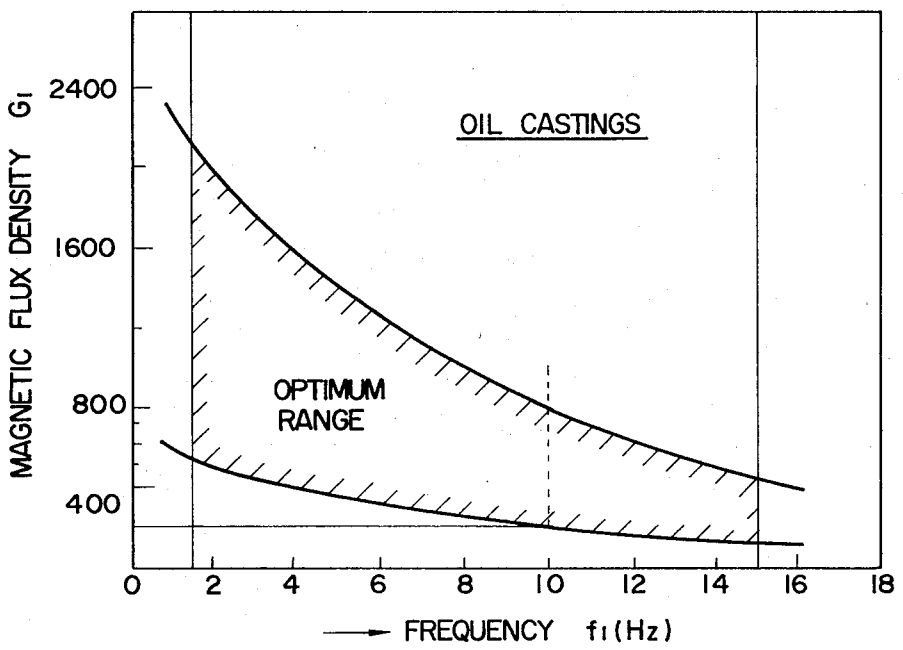
FIG. 2 is a diagram showing the optimum range of the magnetic flux density $G_1$ in the mold in oil casting.

For the above-mentioned reasons, intense stirring is desirable. However, an excessively intense stirring results in an excessive increase in the negative segregation ratio in the surface layer of the c.c. strand, and the hardness of the surface layer is not sufficient to be applied to the succeeding heat-treating process. Thus, the negative segregation ratio must be restricted to a value of −0.2 at the highest. When the frequency $f_1$ is 5 Hz, as seen from FIG. 1, the magnetic flux density $G_1$ (gauss) is 1400 or less. Therefore, considering the occurrence of blow-holes, the appropriate magnetic flux density $G_1$ in the casting mold is in the range of 350 to 1400. As seen from FIG. 2, the abovementioned range becomes narrow and the upper- and the lower- limits thereof become low with an increase in the frequency $f_1$. The upper curve can be represented approximately by $2441e^{-0.11f_1}$ and the lower represented approximately by $602e^{-0.10f_1}$. Thus, the approximate magnetic flux density $G_1$ is in the range of $602e^{-0.10f_1}$ to $2441e^{-0.11f_1}$ and the appropriate frequency $f_1$ of the alternating current is in the range of 1.5 to 15.

(I-2) Combination of a submerged nozzle with powder casting:

Molten steel having the same chemical composition as used in the above-mentioned experiments was fed into the casting mold, through a submerged nozzle, with a lubricant type powder having a chemical composition of, for example, $SiO_2$=33.9% by weight, CaO=34.0% by weight, $Al_2O_3$=4.3% by weight, $Fe_2O_3$=2.0% by weight, $Na_2O$=8.4% by weight, $K_2O$=0.6% by weight, MgO=0.9% by weight, F=5.1% by weight, and C=5.5% by weight.

Figure 3:
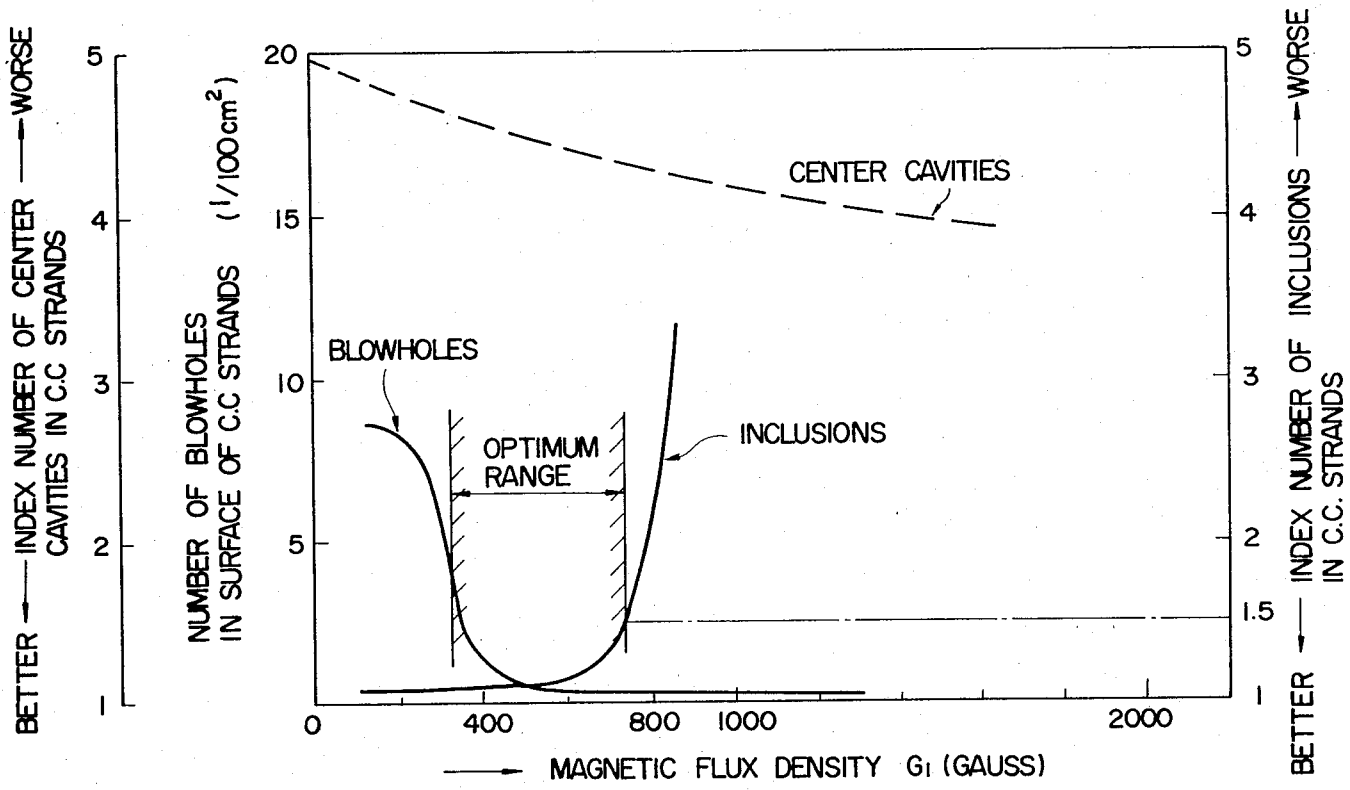
FIG. 3 is a diagram showing the relationship among the magnetic flux density $G_1$, the number of blowholes in surface of c.c. strands the index number of center cavities and the inclusions.

As shown in FIG. 3, the number of blow-holes on the surface of the c.c. strands are reduced with an increase in the intensity of stirring in the mold by the use of the first electromagnetic coil, and thus, the cavities in the center portion of the c.c. strands are also reduced. In contrast to the afore-mentioned oil casting, inclusions in the c.c. strands drastically increase when the intensity of stirring exceeds a certain level, because the powder in the mold is caught up in the molten steel by eddies occurring due to the stirring. Since it is essential to restrict the index number of inclusions to 1.5 or less, as shown in FIG. 3, the upper limitation of the magnetic flux density $G_1$ is 740 when the frequency $f_1$ is 5 Hz. This value of $G_1$ is extremely low as compared with the value (1400) at the negative segregation ratio of −0.2 shown in FIG. 1.

Figure 4:
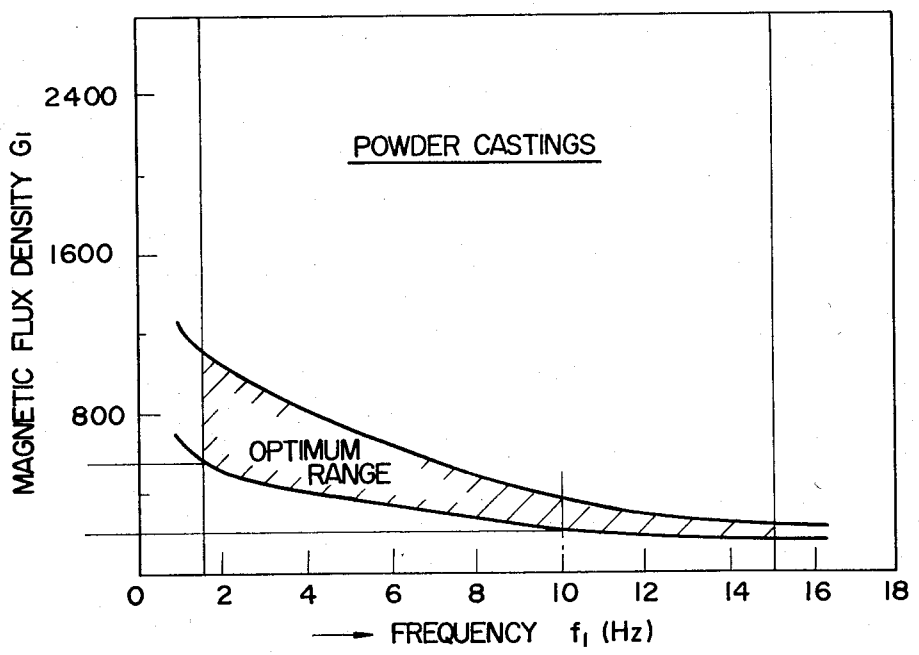
FIG. 4 is a diagram showing the optimum range of the magnetic flux density $G_1$ in powder casting.

Given that the number of blow holes is 5 or less per 100 $cm^2$, the appropriate magnetic flux density $G_1$ is in the range of 350 to 740 when the frequency $f_1$ is 5 Hz. As seen from FIG. 4, the above-mentioned range becomes narrow and the upperand the lower-limits thereof become low with an increase in the frequency $f_1$. The lower curve is represented approximately by $602e^{-0.10f_1}$ and the upper curve represented approximately by $1339e^{-0.12f_1}$. Therefore, the appropriate magnetic flux density $G_1$ is in the range of $602e^{-0.10f_1}$ to $1339e^{-0.12f_1}$ and the appropriate frequency $f_1$ is in the range of 1.5 to 15.

Figure 9A:
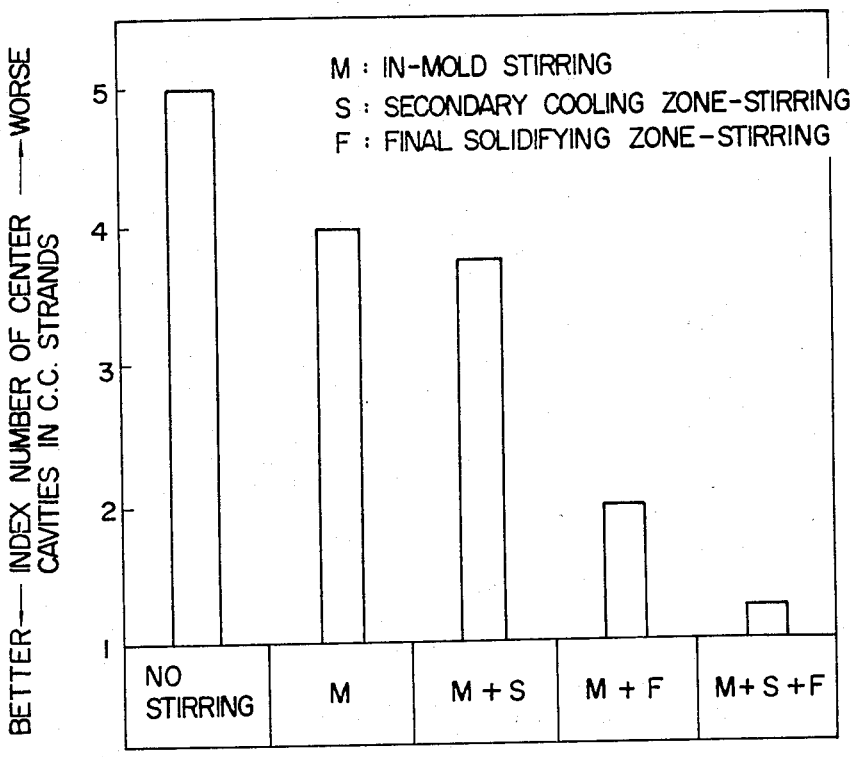
FIG. 9(*a*) is a diagram showing the index number of center cavities in billets subjected to zone stirring in combinations of: the mold, the secondary cooling zone, and the final solidifying zone.
Figure 9B:
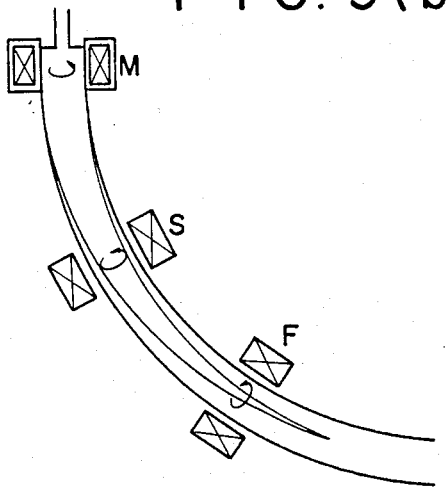
Figure 10:
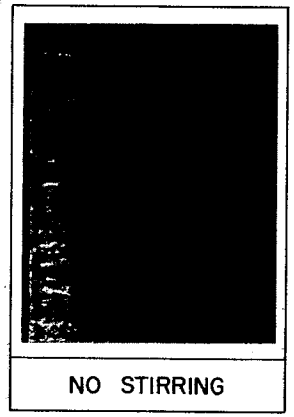
FIGS. 10 to 14 are photographs of macrostructures of the sample billets in section corresponding to the sample c.c. strands in FIG. 9(*a*), respectively.
Figure 11:
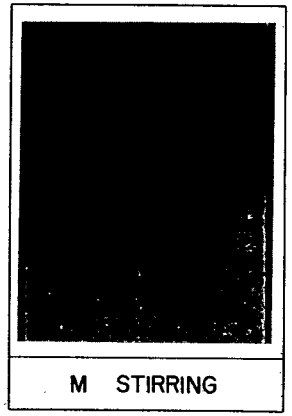
Figure 12:
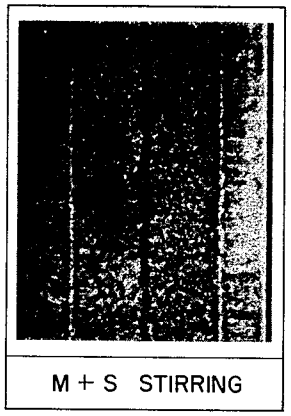
Figure 13:
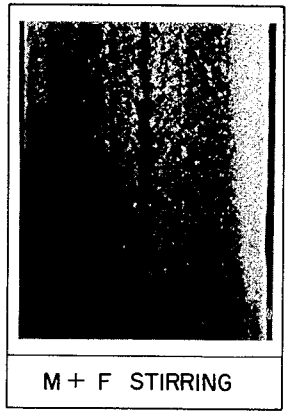
Figure 14:
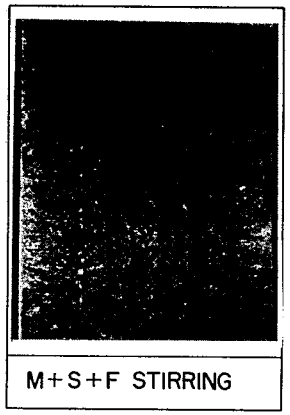

By the electromagnetic stirring treatment within the casting mold according to the optimum conditions mentioned in either Item (I-1) or Item (I-*2*), the index number of center cavities is improved from 5 to 4 as shown in FIG. 9(*a*).

(II) Electromagnetic stirring in the intermediate zone:

Optimum conditions for electromagnetic stirring in the intermediate zone (namely, the secondary cooling zone), in which molten steel solififys as a c.c. strand, are discussed below:

An electromagnetic stirring treatment was performed by a rotating magnetic field induced by the application of an alternating current of 60 Hz to the second electromagnetic coil which was disposed on a lower position at a distance of 3.8 meters from the meniscus of the mold wherein stirring in the casting mold was done at an $f_1$ of 5 Hz and a $G_1$ of 1070.

Figure 5:
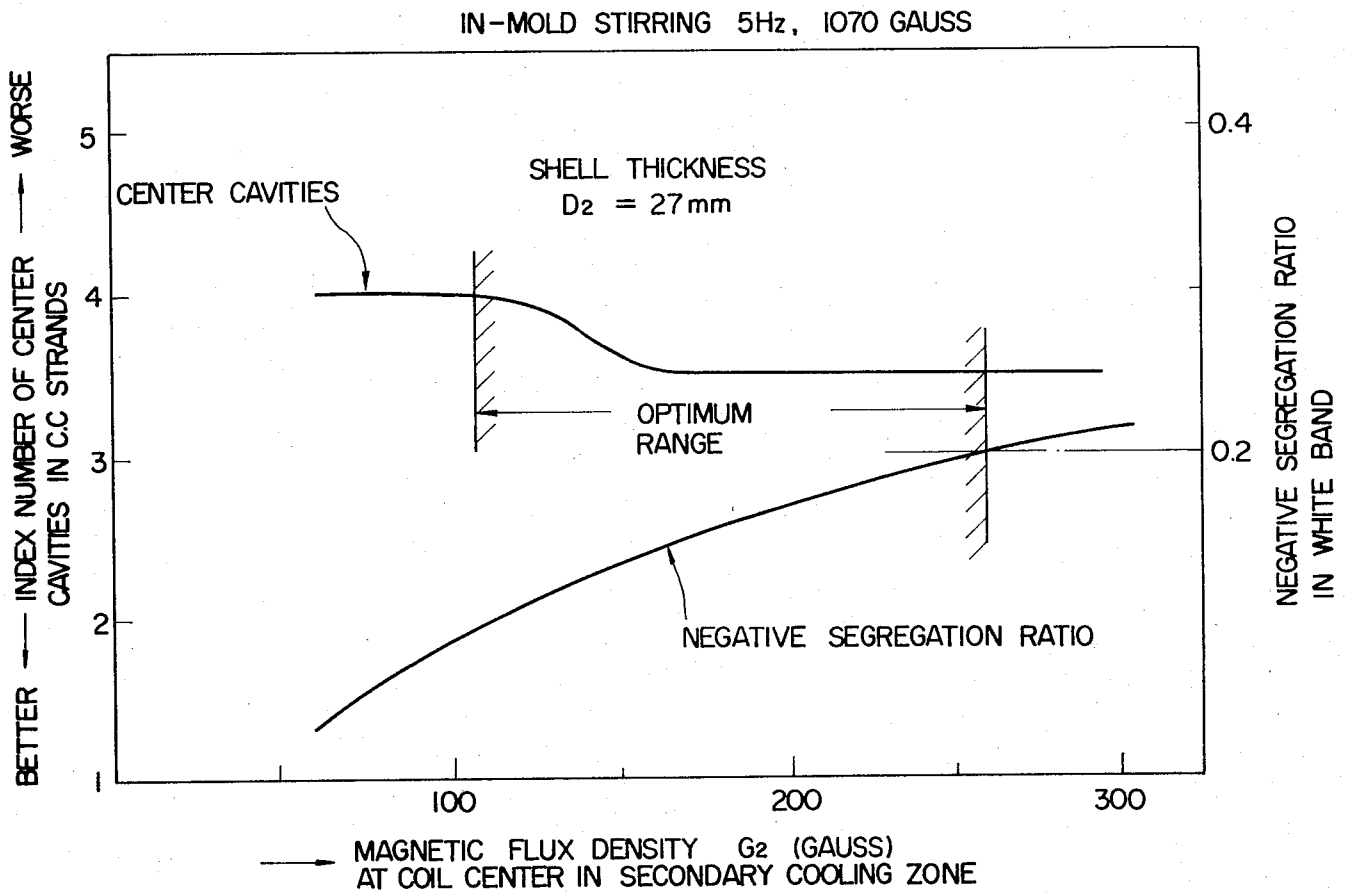
FIG. 5 is a diagram showing the relationship among the magnetic flux density $G_2$, the index number of center cavities and the negative segregation ratio of carbon in the white band in the secondary cooling zone.

FIG. 5 shows the relationship among the magnetic flux density $G_2$ at the center of the second coil, the index number of center cavities and the negative segregation ratio, wherein the index number of center cavities is improved from 4 to 3.5. This can be explained from the fact that electromagnetic stirring has the effect of severing the columnar crystals, increasing the amount of equiaxed crystals, as well. When the thickness $D_2$ of the solidifying shell is 27 mm, the critical value of $G_2$ is 110 which increases with an increase in the shell thickness $D_2$ because the flux decays with an increase in the shell thickness $D_2$.

Also, the negative segregation ratio in the white band increases with an increase in the intensity of the electromagnetic stirring. In light of the succeeding heat-treating process, the upper limit of the intensity of stirring (i.e. the negative segregation ratio in the white band) must be restricted to a certain level, and the negative segregation ratio in the white band is restricted to a value of −0.2, so that the upper limit of the magnetic flux density $G_2$ is given as a value of 257 under the conditions in FIG. 5.

Figure 6:
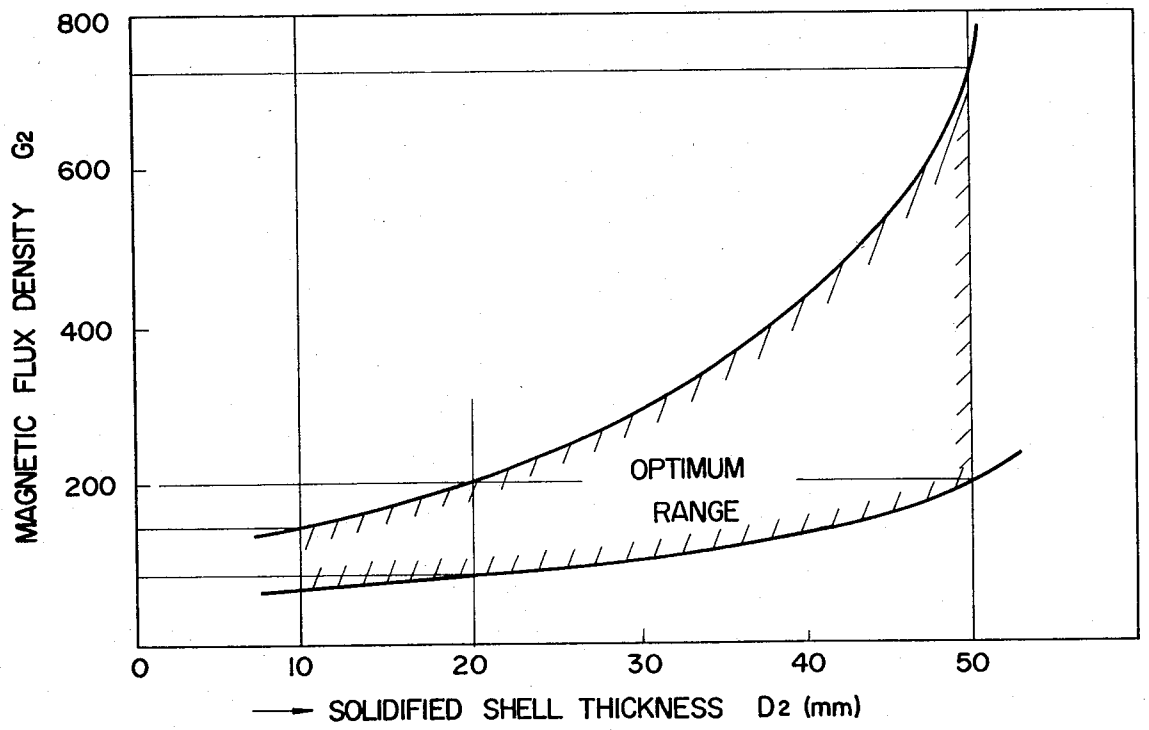
FIG. 6 is a diagram showing the optimum range of the magnetic flux density $G_2$.

Thus, the magnetic flux density $G_2$ is in the range of 110 to 257, varying according to the thickness of the solidifying shell as shown in FIG. 6, wherein both the upper- and the lower-limits of the flux density range become low with a decrease of the shell thickness. The upper curve is represented approximately by $750000/(D_2\text{-}81)^2$, while the lower curve represented approximately by $750000/(D_2\text{-}110)^2$. Therefore, the appropriate magnetic flux density $G_2$ is in the range of $750000/(D_2\text{-}110)^2$ to $750000/(D_2\text{-}81)^2$, while the appropriate thickness $D_2$ of the shell in the range of 10 to 50 mm.

The frequency of the alternating current to be applied to the second electromagnetic coil is not limited to 60 Hz, but any other frequency, e.g. 50 Hz, is applicable in this invention.

(III) Electromagnetic stirring in the final solidifying zone:

Optimum conditions of elecromagnetic stirring in the final solidifying zone, in which the shorter diameter of the molten steel pool is smaller than ½ the length of the shorter side of the c.c. strand (for example; when the shorter side of the c.c. strand is 125 mm×125 mm, the shell thickness $D_3$ is larger than 31 mm) are discussed below:

Electromagnetic stirring was performed by a rotating magnetic field induced by the application of an alternating current of 60 Hz to the third electromagnetic coil which was disposed at a position of the shell thickness $D_3$ of 40 mm, wherein a c.c. strand of 125 mm×125 mm was continuously drawn out at a rate of 2.6 m/min and the stirring was carried out under an $f_1$ of 5 Hz and a $G_1$ of 1070 gauss within the mold and under an alternating current of 60 Hz, a $G_2$ of 190 gauss and a shell thickness $D_2$ of 30 mm in the secondary cooling zone.

Figure 7:
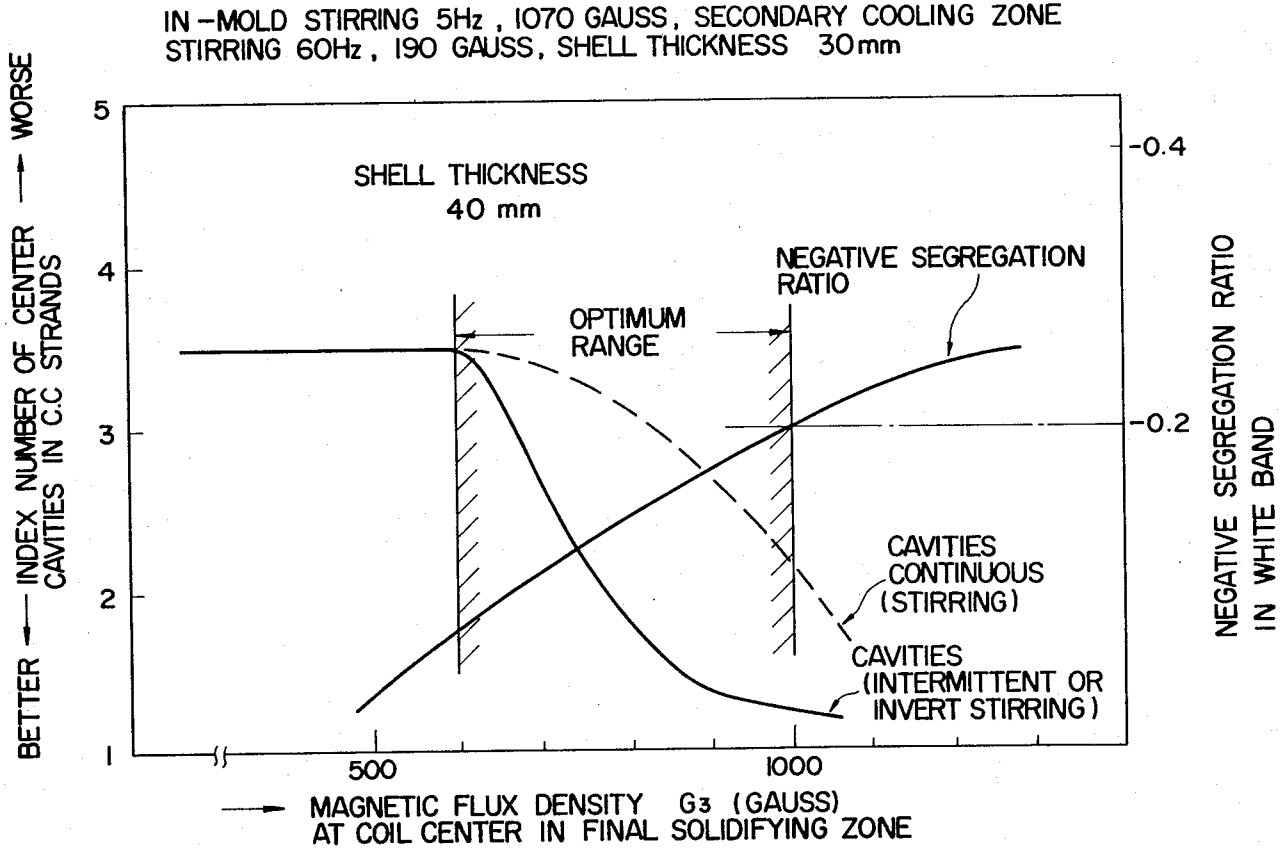
FIG. 7 is a diagram showing the relationship among the magnetic flux density $G_3$, the index number of center cavities and the negative segregation ratio in the white band in the final solidifying zone.

In the final solidifying zone, the temperature in the molten steel pool was low and the viscosity of molten steel was high, such that molten steel in the final solidifying zone should be more intensely stirred than that in the secondary cooling zone. FIG. 7 shows the relationship among the magnetic flux density $G_3$ in the center of the third electromagnetic coil, the index number of center cavities and the negative segregation ratio of carbon in the white band, wherein the index number of center cavities becomes below 3.5 beyond 600 gauss, and nearly equals 2 at around 1000 gauss. It is clear therefrom that the center cavities are significantly improved. This can be explained from the fact that uniformity of the temperature in the pool of molten steel was attained by the stirring treatment in the equiaxed crystal zone resulting from stirring in the casting mold and/or within the secondary cooling zone, and that the massy zone was maintained to be large in cross-section thereby making the shrinkage cavities disperse into the molten steel pool by the stirring treatment.

Since the negative segregation ratio in the white band exceeds −0.2 beyond 1000 gauss, the appropriate magnetic flux density $G_3$ is in the range of 600 to 1000 gauss.

In FIG. 7, the broken line indicates the characteristics of center cavities in the case where stirring was carried out with a continuous electric current, while the solid line indicates the characteristics of center cavities in the case where stirring was carried out with a periodic or intermittent electric current (e.g. at 3 to 10 second intervals) or with a periodically inverted polarity of electric current (e.g. at 3 to 5 second intervals). As seen from FIG. 7, the center cavities are more effectively improved in intermittent or inverted stirring than in continuous stirring, because, due to the rapid change of the stirring intensity or the stirring direction, equiaxed crystal nuclei can be easily admixed resulting in the prompt dispersion of the concentrated molten steel. For the same reasons as mentioned above, stirring under different frequencies is also effective in the final solidifying zone.

Figure 8:
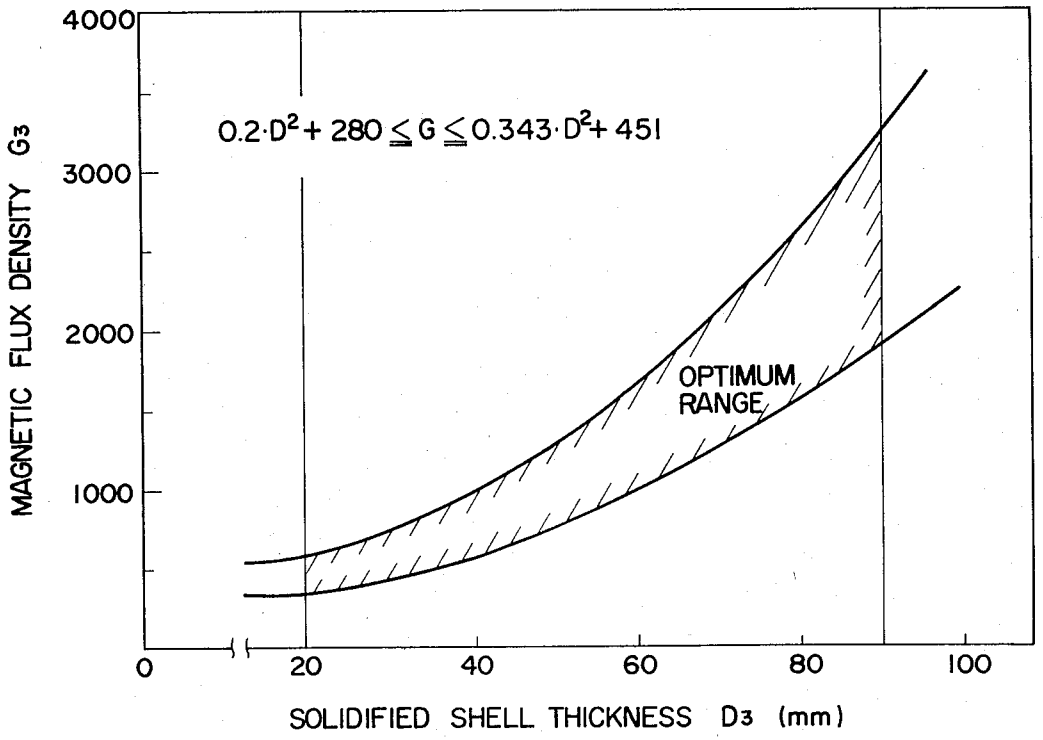
FIG. 8 is a diagram showing the optimum range of the magnetic flux density $G_3$.

The afore-mentioned range of the $G_3$ from 600 to 1000 gauss is varied with the thickness $D_3$ of the shell. FIG. 8 shows a relationship between the thickness $D_3$ of the shell in mm and the magnetic flux density $G_3$ in gauss, wherein the $G_3$ range becomes narrow with a decrease in the shell thickness $D_3$. The upper curve is represented approximately by $0.343 \cdot D_3^2+451$, while the lower curve represented approximately by $0.2 \cdot D_3^2+280$. Thus, the appropriate magnetic flux density $G_3$ is in the range of $0.2 \cdot D_3^2+280$ gauss to $0.343 \cdot D_3^2+451$ gauss, while the appropriate shell thickness $D_3$ is in the range of 20 to 90 mm.

FIG. 9(*a*) shows the effects of reducing center cavities in the c.c. strands according to this invention, in which each of the sample c.c. strands was continuously cast, using molten steel containing 0.11% of carbon, into a billet of 125 mm×125 mm in the same manner as mentioned above, and from which it will be seen that the index number of center cavities can be improved by the combined electromagnetic stirring in the mold and the final solidifying zone rather than in the mold and the intermediate solidifying zone, and the center cavities can be further improved by producing electromagnetic stirring in the intermediate solidifying zone in addition to the stirring in the mold and the final solidifying zone thereby enabling the reduction of the index number of center cavities to 0.25. This indicates that electromagnetic stirring in the final solidifying zone effectively serves to reduce cavities in low carbon killed steel c.c. strands.

Although the center segregation ratio can be improved by electromagnetic stirring in the mold (M) alone as compared with no stirring, it can be further improved by the combined electromagnetic stirring in the mold (M) and the intermediate solidifying zone (S) and/or the final solidifying zone (F), preferably (M+F) and most preferably (M+S+F), thereby providing billets having the same quality as or more excellent than large-sized blooms. This is demonstrated by FIGS. 10 to 14, which are photographs of macrostructures of the sample billets corresponding to the sample c.c. strands in FIG. 9(*a*), respectively, and in which magnification of each of the photographs is about ½.

Although molten steel containing 0.11% of carbon was used in the above-mentioned examples, any low carbon steel containing 0.20% or less of carbon can be applied in the same manner to this invention, thereby producing billets having the same quality as or more superior to blooms having a large size in cross-section.

Thus, the method of the present invention permits the production of low carbon killed steel billets, which are improved as to negative segregations, center cavities, inclusions, surface quality, cold forgeability, and machinability, by a continuous casting process at low cost.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A method for the continuous production of cast steel strands which are 200 mm×200 mm or less in cross-section by a continuous casting process in which molten steel containing 0.20% or less of carbon is fed into a casting mold with a lubricant and continuously drawn out downwardly of the casting mold, said method comprising the steps of:

(a) electromagnetically stirring the molten steel at a position within said casting mold by the application of a magnetic field induced by introducing into an electromagnetic coil an alternating current of a frequency (f) in the range of 1.5 to 15 Hz and maintaining the magnetic flux density in the range of $602\ e^{-0.10f}$ to $2441\ e^{-0.11f}$ gauss at the center of the electromagnetic coil, and (b) electromagnetically stirring the molten steel at a position in the final solidfying zone of said continuously cast strands in which the shorter diameter of the molten steel pool is smaller than ½ the length of the shorter side of the cast strand, by the application of a magnetic field induced by introducing an alternating current having a freqency in the range of 50 to 60 Hz into an electromagnetic coil and maintaining the magnetic flux density in the range of $0.2 \cdot D^2+280$ gauss to $0.343 \cdot D^2+451$ gauss at the center of the electromagnetic coil, wherein D is the solidified shell thickness in millimeters of said continuously cast strands, the value of D ranging from 20 to 90.

2. A method according to claim 1, which further comprises the step of electromagnetically stirring the molten steel at a position in the intermediate solidifying zone of said continuously cast strand by the application of a magnetic field induced by introducing an alternating current into an electromagnetic coil and maintaining the magnetic flux density in the range of $750000/(D-110)^2$ gauss to $750000/(D-81)^2$ gauss at the center of the electromagnetic coil, wherein D is the solidified shell thickness in millimeters of said continuously cast strand, the value of said D ranging from 10 to 50, and said intermediate solidifying zone being a zone between said casting mold and said final solidifying zone.

3. A method according to claim 1 or 2, wherein said lubricant is oil or powder.

4. A method according to claim 3, wherein said lubricant is powder and said magnetic flux density at the center of the electromagnetic coil in said casting mold is in the range of $602e^{-0.10f}$ gauss to $1339e^{-0.12f}$ gauss.

5. A method according to claim 1, wherein said stirring in the final solidifying zone is induced by an intermittent electric current.

6. A method according to claim 1, wherein said stirring in the final solidifying zone is induced by an electric current the polarity of which is periodically inverted.

7. A method of producing continuously cast strands which are less than 200 mm×200 mm in cross-section by a continuous casting process in which molten steel containing 0.20% or less carbon and a lubricant is fed into a casting mold and continuously drawn out downwardly of the casting mold, said method comprising the steps of:

(a) electromagnetically stirring the molten steel at a position within said casting mold by application of a magnetic field induced by an alternating current of a frequency f of between 1.5 Hz and 15 Hz and having a magnetic flux density G at the center of the molten steel in the range of $602\ e^{-0.10f}$ gauss to $2{,}441\ e^{-0.11f}$ gauss, and also (b) electromagnetically stirring the molten steel at a position in the final solidifing zone of each of said continuously cast strands by application of a magnetic field induced by an alternating current having a frequency in the range of 50 to 60 Hz and having a magnetic flux density G at the center of the molten steel in the range of $0.2\ D^2+280$ gauss to $0.343\ D^2+451$ gauss, where D is the solidified shell thickness of each of said continuously cast strands in millimeters, said final solidifying zone being defined as a zone where the molten steel in each of said continuously cast strands is present as a molten steel pool having a generally circular or ovular cross-sectional shape, in which the shorter diameter of the molten steel pool is less than ½ the length of the shorter side of the cast strand, and the value of D is between 20 and 90.

8. A method as recited in claim 7 and further comprising the step of electromagnetically stirring the molten steel at a position in an intermediate solidifying zone of each of said continuously cast strands by application of a magnetic field induced by an alternating current and having a magnetic flux density G at the center of the molten steel in the range of $750{,}000/(D\text{-}110)^2$ gauss to $750{,}000/(D\text{-}81)^2$ gauss, where D is the solidified shell thickness of each of said continuously cast strands in millimeters, said intermediate solidifying zone being defined as a zone between said casting mold and said final solidifying zone in which the value of D is between 10 and 50.

9. A method as recited in claim 7 or 8 wherein said lubricant is oil or powder.

10. A method as recited in claim 7 or 8 wherein:

(a) said lubricant is powder and (b) the magnetic flux density G at the center of the molten steel in said casting mold is in the range of $602e^{-0.10f}$ gauss to $1{,}339e^{-0.12f}$ gauss.

11. A method as recited in claim 7 wherein the electromagnetic stirring in said final solidifying zone is induced by an intermittent electric current.

12. A method as recited in claim 7 wherein the electromagnetic stirring in said final solidifying zone is induced by an electric current the polarity of which is periodically inverted.

* * * * *